US011103411B2

(12) United States Patent
Saglia et al.

(10) Patent No.: US 11,103,411 B2
(45) Date of Patent: Aug. 31, 2021

(54) DRIVING SYSTEM FOR CONTROLLING THE ROTATION OF AN OBJECT ABOUT TWO PERPENDICULAR AXES OF ROTATION AND REHABILITATION MACHINE FOR REHABILITATION OF THE LOWER LIMBS AND THE TRUNK INCORPORATING SUCH A DRIVING SYSTEM

(71) Applicant: FONDAZIONE ISTITUTO ITALIANO DI TECNOLOGIA, Genoa (IT)

(72) Inventors: Jody Alessandro Saglia, Genoa (IT); Stefano D'Angella, Albisola Superiore (IT); Lucia Ciaccia, Rome (IT); Carlo Sanfilippo, Genoa (IT); Simone Ungaro, Rome (IT)

(73) Assignee: FONDAZIONE ISTITUTO ITALIANO DI TECNOLOGIA, Genoa (IT)

( * ) Notice: Subject to any disclaimer, the term of this patent is extended or adjusted under 35 U.S.C. 154(b) by 355 days.

(21) Appl. No.: 15/560,845

(22) PCT Filed: Mar. 24, 2016

(86) PCT No.: PCT/IB2016/051683
§ 371 (c)(1),
(2) Date: Sep. 22, 2017

(87) PCT Pub. No.: WO2016/151527
PCT Pub. Date: Sep. 29, 2016

(65) Prior Publication Data

US 2018/0110670 A1 Apr. 26, 2018

(30) Foreign Application Priority Data

Mar. 24, 2015 (IT) ..... 102015000009678

(51) Int. Cl.
*A61H 1/02* (2006.01)
*A63B 69/00* (2006.01)
(Continued)

(52) U.S. Cl.
CPC ..... *A61H 1/0266* (2013.01); *A63B 21/002* (2013.01); *A63B 21/0023* (2013.01);
(Continued)

(58) Field of Classification Search
CPC . A61H 1/00; A61H 1/005; A61H 1/02; A61H 1/0237; A61H 1/0266;
(Continued)

(56) References Cited

U.S. PATENT DOCUMENTS 5,170,776 A * 12/1992 Pecheux ..... A61H 1/0266 601/104
5,211,161 A * 5/1993 Stef ..... A61H 1/0266 601/31
(Continued)

FOREIGN PATENT DOCUMENTS

| | | | |
|---|---|---|---|
| CN | 101006958 | A | 8/2007 |
| WO | 2013/093787 | A1 | 6/2013 |
| WO | 2014/085732 | A1 | 6/2014 |

OTHER PUBLICATIONS

International Search Report for PCT/IB2016/051683 dated Jun. 28, 2016.

*Primary Examiner* — Justine R Yu
*Assistant Examiner* — Matthew D Ziegler
(74) *Attorney, Agent, or Firm* — Arent Fox LLP; Michael Fainberg

(57) ABSTRACT

The driving system comprises: a first support structure; a second support structure supported by the first support structure for rotation about a stationary axis of rotation; a first actuation unit having a first motor device and a first
(Continued)

output member; and a second actuation unit having a second motor device and a second output member. The first output member is drivingly connected with the second support structure for rotation about the first axis of rotation. The first motor device controls the rotation of the first output member, along with the second support structure, about the first axis of rotation. The second output member is supported by the second support structure for rotation about a second axis of rotation. The second motor device controls the rotation of the second output member about the second axis of rotation.

6 Claims, 14 Drawing Sheets

(51) Int. Cl.

| | |
|---|---|
| ***A63B 71/06*** | (2006.01) |
| ***A63B 21/005*** | (2006.01) |
| ***A63B 22/18*** | (2006.01) |
| ***A63B 23/08*** | (2006.01) |
| ***A63B 21/00*** | (2006.01) |
| ***A63B 26/00*** | (2006.01) |
| ***A63B 21/002*** | (2006.01) |
| ***A63B 21/22*** | (2006.01) |
| ***A63B 22/00*** | (2006.01) |
| ***A63B 24/00*** | (2006.01) |
| ***A63B 71/00*** | (2006.01) |

(52) U.S. Cl.

CPC .... *A63B 21/0058* (2013.01); *A63B 21/00178* (2013.01); *A63B 21/00181* (2013.01); *A63B 21/22* (2013.01); *A63B 21/4015* (2015.10); *A63B 21/4034* (2015.10); *A63B 22/0087* (2013.01); *A63B 22/18* (2013.01); *A63B 23/08* (2013.01); *A63B 24/0087* (2013.01); *A63B 26/003* (2013.01); *A63B 69/0057* (2013.01); *A63B 69/0064* (2013.01); *A63B 71/0054* (2013.01); *A63B 71/0622* (2013.01); *A61H 2201/018* (2013.01); *A61H 2201/0176* (2013.01); *A61H 2201/1215* (2013.01); *A61H 2201/1633* (2013.01); *A61H 2201/1642* (2013.01); *A61H 2201/1676* (2013.01); *A61H 2201/5002* (2013.01); *A61H 2201/5061* (2013.01); *A61H 2201/5064* (2013.01); *A61H 2201/5069* (2013.01); *A61H 2201/5092* (2013.01); *A63B 2022/0094* (2013.01); *A63B 2071/0081* (2013.01); *A63B 2071/0636* (2013.01); *A63B 2071/0683* (2013.01); *A63B 2208/0204* (2013.01); *A63B 2208/0233* (2013.01); *A63B 2220/16* (2013.01); *A63B 2220/24* (2013.01); *A63B 2220/51* (2013.01); *A63B 2220/52* (2013.01); *A63B 2220/54* (2013.01); *A63B 2220/805* (2013.01); *A63B 2225/093* (2013.01)

(58) Field of Classification Search

CPC .... A61H 2001/0203; A61H 2001/0207; A61H 2201/0119; A61H 2201/0149; A61H 2201/0173; A61H 2201/0176; A61H 2201/018; A61H 2201/12; A61H 2201/1207; A61H 2201/1215; A61H 2201/1633; A61H 2201/1642; A61H 2201/1676; A61H 2201/50; A61H 2201/5002; A61H 2201/5058; A61H 2201/5061; A61H 2201/5064; A61H 2201/5069; A61H 2201/5092; A61H 2203/04; A61H 2203/0425; A61H 2203/0431; A61H 2205/10; A61H 2205/106; A63B 21/00178; A63B 21/00181; A63B 21/002; A63B 21/0023; A63B 21/0058; A63B 21/22; A63B 21/4015; A63B 21/4043; A63B 22/0087; A63B 22/14; A63B 22/16; A63B 22/18; A63B 2022/0094; A63B 2022/185; A63B 23/08; A63B 23/085; A63B 24/0087; A63B 26/003; A63B 69/0057; A63B 69/0064; A63B 71/0054; A63B 71/0622; A63B 2071/0081; A63B 2071/0636; A63B 2071/0683; A63B 2208/0204; A63B 2208/0233; A63B 2220/16; A63B 2220/24; A63B 2220/51; A63B 2220/52; A63B 2220/54; A63B 2220/805; A63B 2225/093

See application file for complete search history.

(56) References Cited

U.S. PATENT DOCUMENTS

| | | | | |
|---|---|---|---|---|
| 5,352,185 | A * | 10/1994 | Blauth | A61H 1/0266 482/79 |
| 6,878,102 | B1 | 4/2005 | Commisso | |
| 8,206,267 | B2 * | 6/2012 | Holden | A63B 24/0087 482/4 |
| 8,986,232 | B2 | 3/2015 | Saglia et al. | |
| 9,603,768 | B1 * | 3/2017 | Widmer | A61H 1/024 |
| 2006/0229159 | A1 * | 10/2006 | Nagata | A63B 22/16 482/1 |
| 2008/0234113 | A1 * | 9/2008 | Einav | A61B 5/103 482/66 |
| 2009/0082704 | A1 * | 3/2009 | Nov | A61H 1/005 601/27 |
| 2010/0010397 | A1 * | 1/2010 | Ochi | A61H 1/005 601/27 |
| 2010/0248921 | A1 * | 9/2010 | Shinomiya | A61H 1/0255 482/142 |
| 2011/0046524 | A1 * | 2/2011 | Mihara | A61H 1/001 601/5 |
| 2015/0328497 | A1 * | 11/2015 | Doucot | A63B 21/00181 482/146 |
| 2016/0324713 | A1 * | 11/2016 | Halperin | A61H 1/0244 |

* cited by examiner

DRIVING SYSTEM FOR CONTROLLING THE ROTATION OF AN OBJECT ABOUT TWO PERPENDICULAR AXES OF ROTATION AND REHABILITATION MACHINE FOR REHABILITATION OF THE LOWER LIMBS AND THE TRUNK INCORPORATING SUCH A DRIVING SYSTEM

CROSS-REFERENCE TO RELATED APPLICATIONS

This application is a National Stage entry of International Application No. PCT/IB2016/051683, filed Mar. 24, 2016, which claims Mar. 24, 2015, the disclosures of these priority applications are incorporated in their entirety herein by reference.

BACKGROUND OF THE INVENTION

The present invention relates to a driving system for controlling the movement of an object, in particular a platform or a seat for a rehabilitation machine for rehabilitation of the lower limbs and the trunk, with two degrees of freedom of rotation about two axes of rotation perpendicular to each other and intersecting each other. According to a further aspect, the present invention relates to a rehabilitation machine for rehabilitation of the lower limbs and the trunk comprising a platform on which the patient may rest with one foot or both feet, a first driving system for controlling the rotation of the platform about two perpendicular axes of rotation, a seat and a second driving system for controlling the rotation of the seat about two perpendicular axes of rotation.

Pathologies of the lower limbs and of the vertebral column are often treated acting simultaneously on several districts of the body since these latter are closely dependent on each other. Treatment of the pathologies of the lower limbs may not, in fact, be performed without considering the trunk and the pelvis, since the trunk and the pelvis have muscles which are important both for the stability of the body and for the movements of the lower limbs. This is the case for example of training for the trunk stability, where the patient must perform exercises both in the erect position and in the sitting position, so as to train the muscles of the trunk which are important for the stability and movement of the body and for maintaining the posture. These exercises often form part of the protocol for rehabilitation of the lower limbs.

To date there are no devices or apparatuses which allow treatment of the patient both in the erect position and in the sitting position in a simultaneously passive and active manner and with the possibility of quantifying the extent of recovery through measurement of biomechanical and functional parameters. In particular, if is very difficult for the patient to carry out passive mobilization exercises of the pelvis using the known apparatuses. Physiotherapists assess the functionality of the whole body before starting a rehabilitation process and therefore they would need a single apparatus in order to assess the functionality of the various body districts linked to each other. A single apparatus would in fact allow physiotherapists to minimize the duration and maximize the effectiveness of the rehabilitation treatment, since they would no longer have to use different devices in order to treat fully a body district and therefore would no longer have to move the patient from one device to another during the same rehabilitation protocol.

The exercises required by the standard rehabilitation protocols are nowadays carried out using various devices, including for example devices for continuous passive mobilization (CPM), dynamometers, rubber bands, Bobath balls, Swiss balls, proprioceptive footboards, etc. Many of these devices are simple devices which operate in a passive manner and do not allow objective measurement of the parameters involved, such as for example force, displacement, action of the load, deviation from the equilibrium position, etc. When devices provided with measuring means are used, the data obtained cannot be combined with those of other devices, so that it is difficult to record the measurements obtained in a digital database and correlate the measurements obtained in order to carry out an overall and complete evaluation of the patient.

International patent application WO2010/092497 in the Applicant's name discloses a rehabilitation device, in particular for the treatment of heel injuries, comprising a support base, a movable platform on which the patient's foot may be fixed by means of fixing straps with Velcro fasteners, a central upright which is fixed at its bottom end to the support base and is connected at its top end to the platform by means of a universal joint, and three "active" legs each comprising a linear actuator with a body connected at its bottom end by means of a universal joint to the support base and with a stem connected at its top end to the platform by means of a ball joint. This known device allows to perform different types of exercises which are useful not only for the treatment of heel injuries, but also for trunk training and equilibrium training, and also allows to measure the parameters involved in an objective manner. However, this known device has a number of drawbacks in terms of size, stiffness and dexterity. In particular, this known device has a considerable size in height, which results in the need to provide around the platform a base with steps for allowing the patient to mount the platform, thus making the device unsuitable for medical applications.

An equilibrium training device is also known, which is marketed under the name of HUBER® MOTION LAB by the company LPG SYSTEMS. This further known device comprises a movable platform with two degrees of freedom of rotation about two perpendicular axes of rotation and a driving system for controlling the movement of the platform. More specifically, the driving system comprises two linear actuators which are connected by means of a universal joint to the bottom end of an arm fixed at its top end to the centre of the bottom side of the platform. In this case also, a drawback of the device is the considerable size in height, due in particular to the length of the arm, which length may not be smaller than a certain value to allow the driving system to provide torque values sufficient for supporting the weight of the patient acting (fully) on the platform. A further drawback of this known device is that the device may be used only for bipodalic training.

WO2014/085732, on which the preamble of independent claim 1 is based, discloses a machine for heel rehabilitation and equilibrium training which comprises a movable platform for supporting the foot of a patient and a driving system for controlling the rotation of the platform about two axes of rotation perpendicular to each other and intersecting each other, more specifically an eversion/inversion axis and flexion/extension axis. The movable platform is supported by a movable frame for rotation about the eversion/inversion axis, while the movable frame is supported by a fixed frame for rotation about the flexion/extension axis. The driving system comprises a first electromechanical driving unit for controlling rotation of the movable frame about the flexion/ extension axis and a second electromechanical driving unit for controlling rotation of the movable platform about the eversion/inversion axis. The driving system proposed in this prior art document is particularly bulky, both vertically and horizontally, and therefore allows rotations within a limited range. Moreover, the movable platform allows only one foot to be placed on it and therefore the machine requires two movable platforms, and hence two driving systems, in order to allow the patient to perform bipodalic training.

SUMMARY OF THE INVENTION

It is an object of the present invention to provide a driving system for controlling the rotation of an object, such as in particular a platform and/or a seat of a rehabilitation machine, about two axes of rotation perpendicular to each oilier and intersecting each other, which is more compact than the prior art discussed above. A further object of the present invention is to provide a driving system able to control rotational movements about the two axes of rotation within angular ranges compatible with the angular ranges of the rotational movements of the heel joint (eversion/inversion movements and flexion/extension movements). Yet another object of the present invention is to provide a rehabilitation machine which allows to perform rehabilitation exercises of the lower limbs, in particular of the heel, as well as exercises for training the equilibrium and the stability of the trunk both in monopodalic and bipodalic mode.

These and other objects are fully achieved according to the present invention by virtue of a driving system and a rehabilitation machine as claimed herein.

BRIEF DESCRIPTION OF THE DRAWINGS

The characteristics and advantages of the present invention will become clear from the following detailed description, given purely by way of a non-limiting example with reference to the accompanying drawings, in which.

DETAILED DESCRIPTION OF EXEMPLARY EMBODIMENTS

Figure 1:
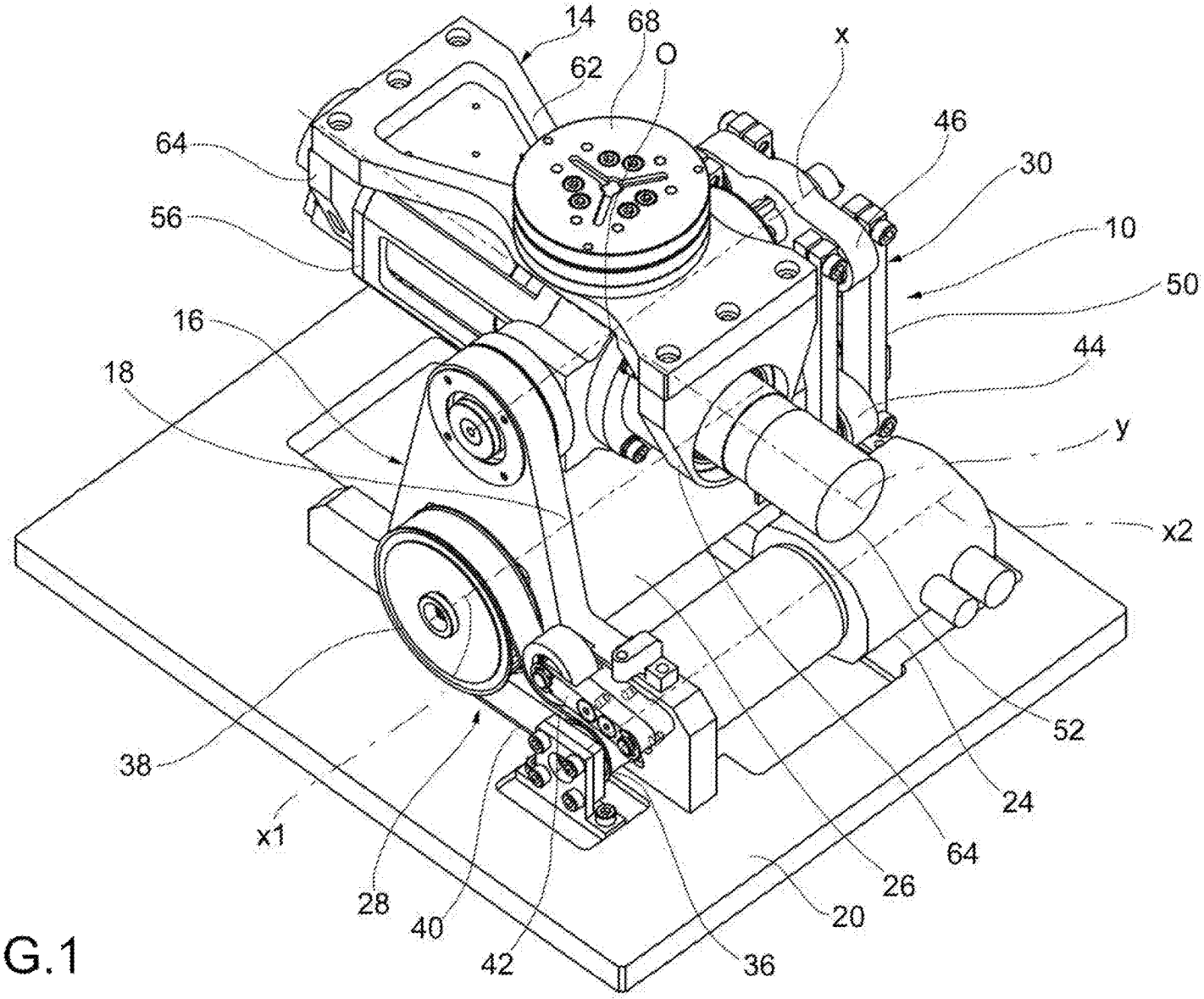
FIG. 1 is a perspective view of a driving system for controlling the rotation of an object about two axes of rotation perpendicular to each other and intersecting each other, according to an embodiment of the present invention.

With reference first to FIGS. 1 to 4, numeral 10 generally indicates a driving system for controlling the movement of an object, such as in particular a platform for a rehabilitation machine for rehabilitation of the lower limbs and the trunk (as will be explained in detail further below with reference to FIGS. 7 to 13), with two degrees of-freedom of rotation about two axes of rotation x and y perpendicular to each other and intersecting each other at a centre of rotation O, the two axes of rotation being hereinafter referred to as first axis of rotation x and second axis of rotation y, respectively. The driving system 10 basically comprises a first actuation unit for controlling the degree of freedom of rotation about the first axis of rotation x and a second actuation unit for controlling the degree of freedom of rotation about the second axis of rotation y. The first actuation unit comprises a first output member 12 and a first motor device for controlling the rotation, via first motion transmission means, of the first output member 12 about the first axis of rotation x. The second actuation unit comprises a second output member 14 and a second motor device for controlling the rotation, via second motion transmission means, of the second output member 14 about the second axis of rotation y. The second output member 14 is supported rotatable about the second axis of rotation y. The second motor device is drivingly connected with the first output member 12 for rotation about the first axis of rotation x, the assembly formed by the second motor device and the first output member 12 being supported by a stationary support structure 16 rotatably about the first axis of rotation x. The second output member 14 (and therefore the object fixed to it, such as in particular a platform of a rehabilitation machine) may therefore rotate simultaneously about the first axis of rotation x and the second axis of rotation y under the control of the first and second actuation units.

The stationary support structure 16 comprises a pair of vertical support plates 18 which are arranged parallel to each other and are fixed to a base 20. A respective bearing 22 is mounted in each support plate 18, in particular at the top end thereof. The two bearings 22 define the first axis of rotation x, which is a stationary axis of rotation (i.e. it is fixed with respect to the stationary support structure 16) and is oriented horizontally. The assembly formed by the second motor device and by the first output member 12 is supported by the stationary support structure 16 via the bearings 22 for rotation about the first axis of rotation x.

The first actuation unit comprises, in addition to the first output member 12, an electric motor 24, a reducer gear 26, a first motion transmission mechanism 28 connecting the electric motor 24 to the reducer gear 26 and a second motion transmission mechanism 30 correcting the reducer gear 26 to the first output member 12. The reducer gear 26 is mounted between the support plates 18 below the first axis of rotation x. The reducer gear 26 comprises an input shaft 32 and an output shaft 34, winch are supported rotatably about a same axis of rotation x1. The axis of rotation x1 extends parallel to the first axis of rotation x and is therefore also oriented horizontally. Preferably, the axis of rotation x1 lies in the vertical plane passing through the first axis of rotation x. The electric motor 24 is mounted on the base 20 of the stationary support structure 16 alongside the reducer gear 26. The electric motor 24 comprises, in a per-se-known manner, a drive shaft (not shown), the axis of rotation of which, indicated x2, extends parallel to the first axis of rotation x. The axis of rotation x2, like the axis of rotation x1, is placed underneath the first axis of rotation x. The rotary motion of the drive shaft about the axis of rotation x2 generated by the electric motor 24 is transmitted to the input shaft 32 of the reducer gear 26 via the first motion transmission mechanism 28.

As can be seen in particular in FIG. 1, in the embodiment, proposed herein the first motion transmission mechanism 28 is a belt transmission mechanism and basically comprises a driving pulley 36 mounted on the drive shaft of the electric motor 24 so as to be drivingly connected for rotation therewith, a driven pulley 38 mounted on the input shaft 32 of the reducer gear 26 so as to be drivingly connected for rotation therewith and a belt 40 wound around the driving pulley 36 and the driven pulley 38. Preferably, the first motion transmission mechanism 28 further comprises a chain-tensioning device 42, of per-se-known type. The first motion transmission mechanism 28 is configured to perform a first reduction of the transmission ratio, so as to allow the dimensions of the reducer gear 26 to be kept small. In the embodiment illustrated, therefore, the driving pulley 36 has a smaller diameter than that of the driven pulley 38.

Figure 2:
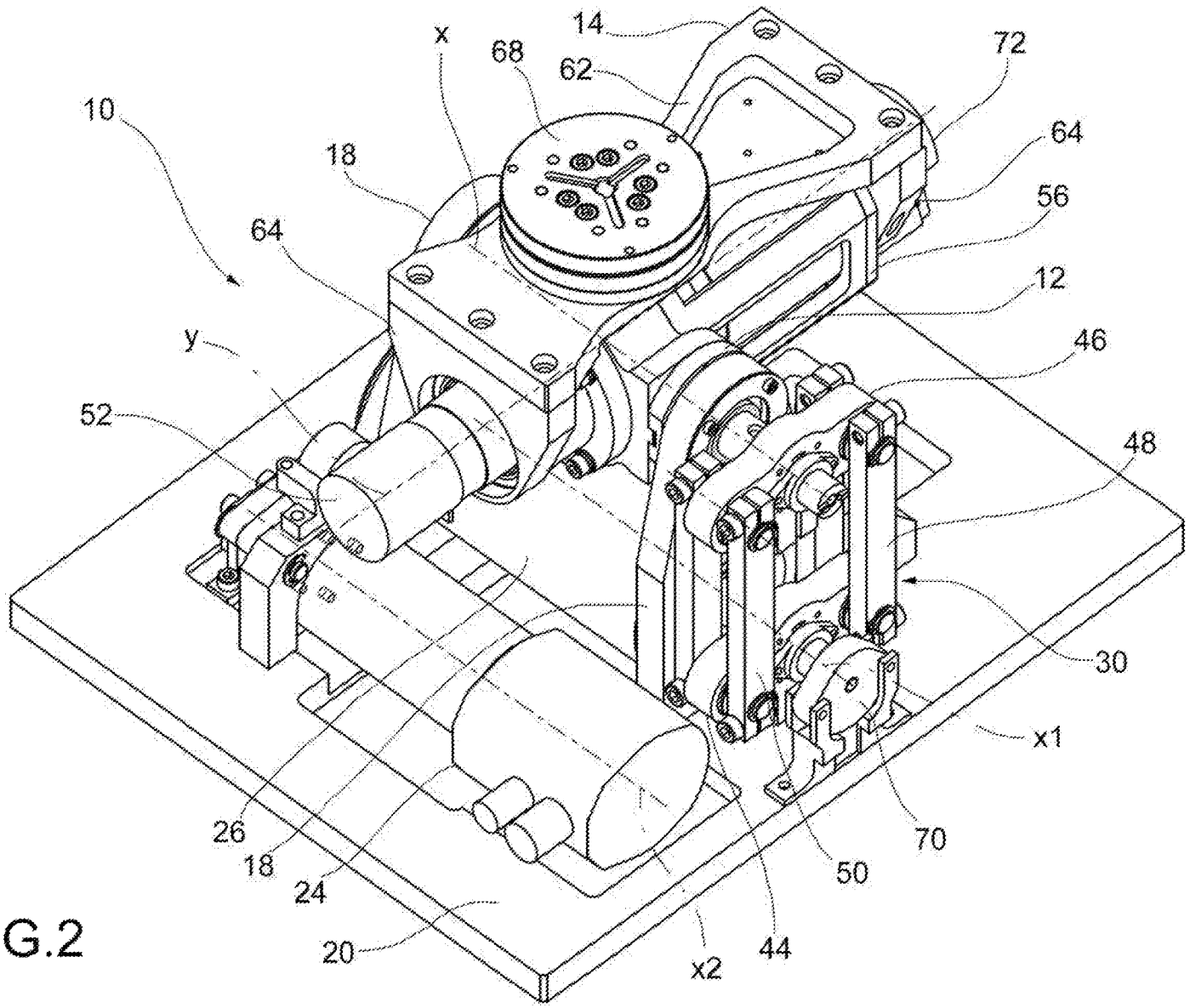
FIG. 2 is a perspective view of the driving system of FIG. 1, from a viewpoint different from that of FIG. 1.
Figure 3:
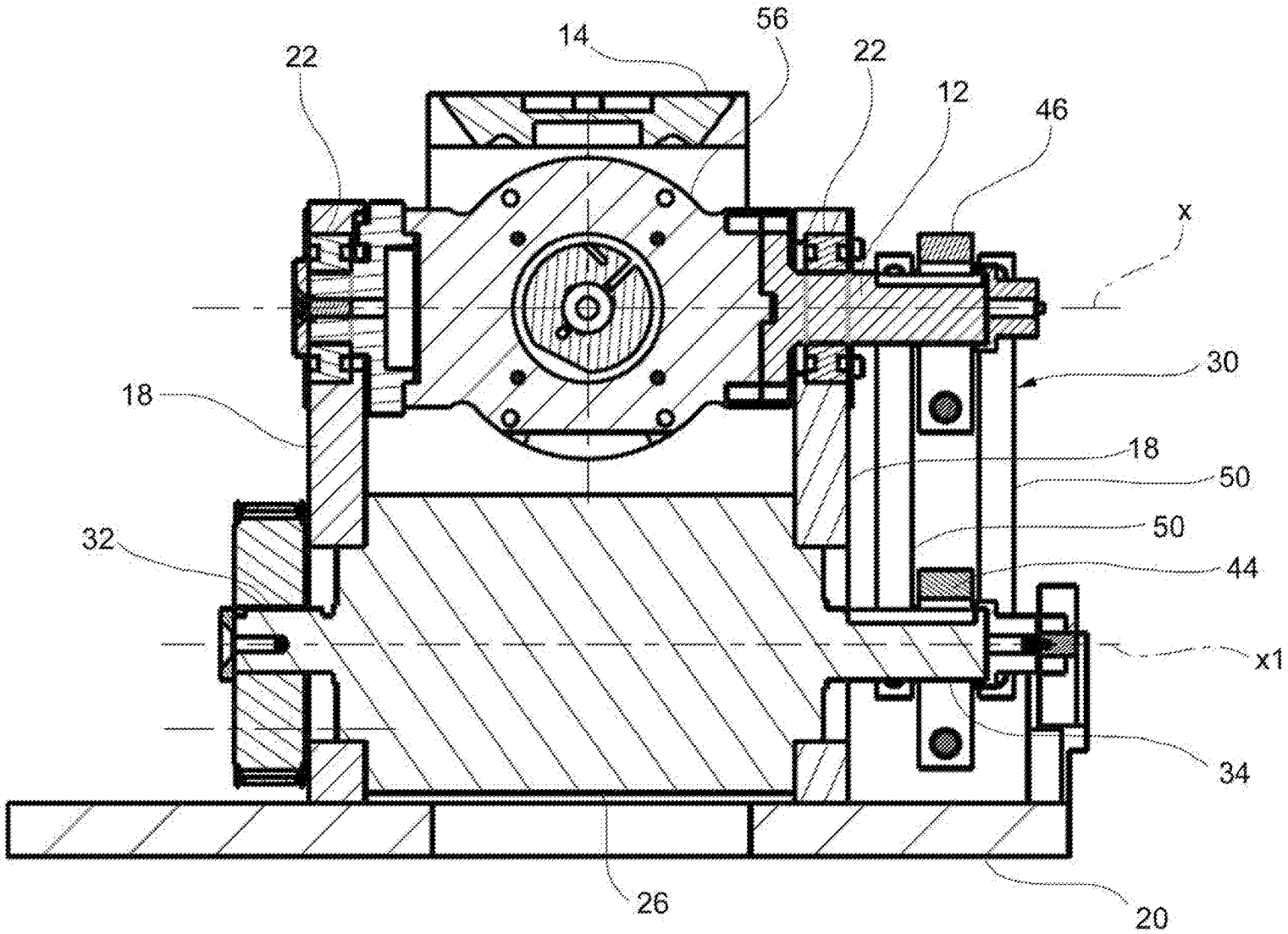
FIG. 3 is a cross-sectional view of the driving system of FIG. 1 in a vertical plane passing through the first axis of rotation.
Figure 4:
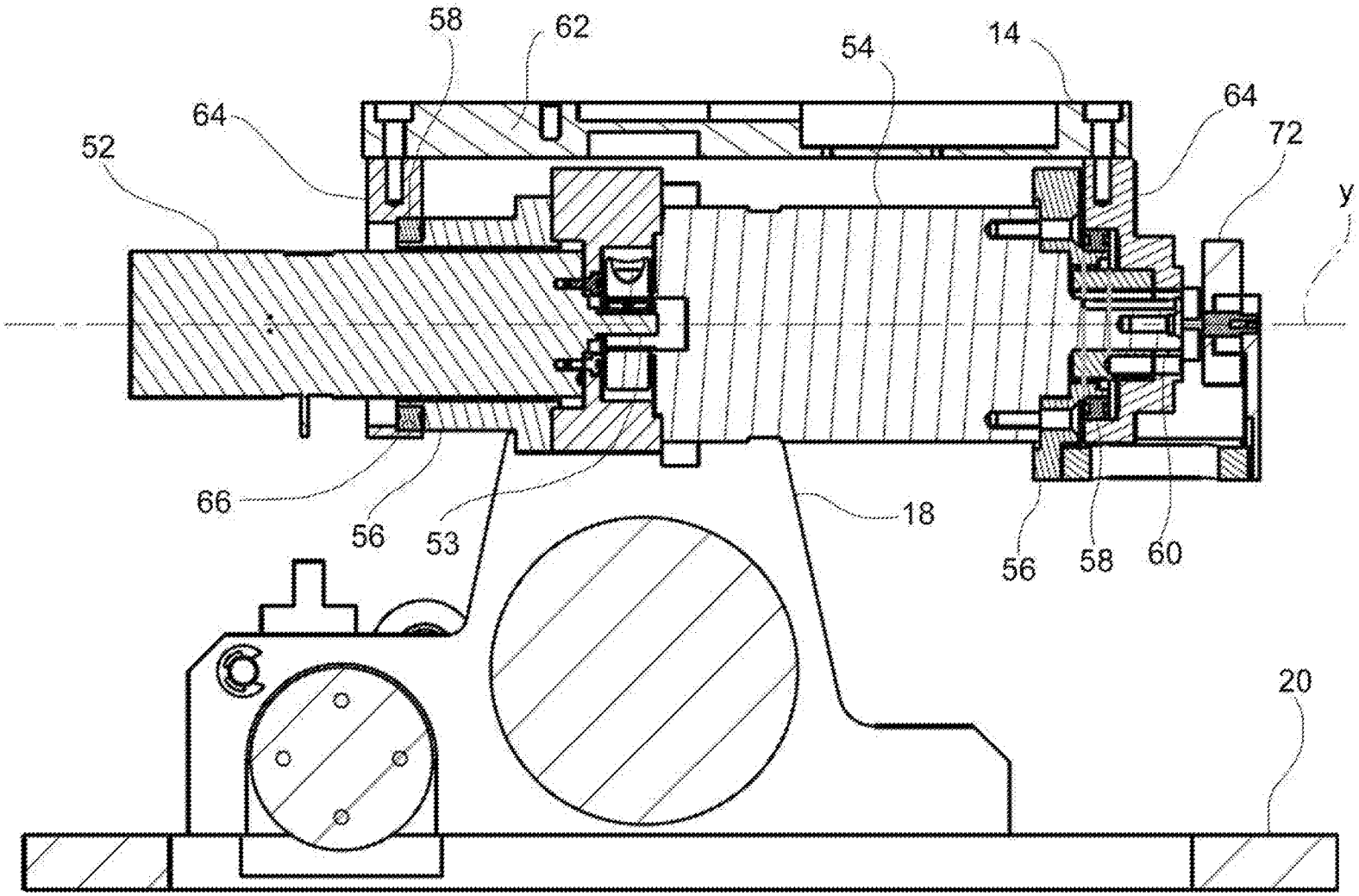
FIG. 4 is a cross-sectional view of the driving system of FIG. 1 in a vertical plane passing through the second axis of rotation.
Figure 5:
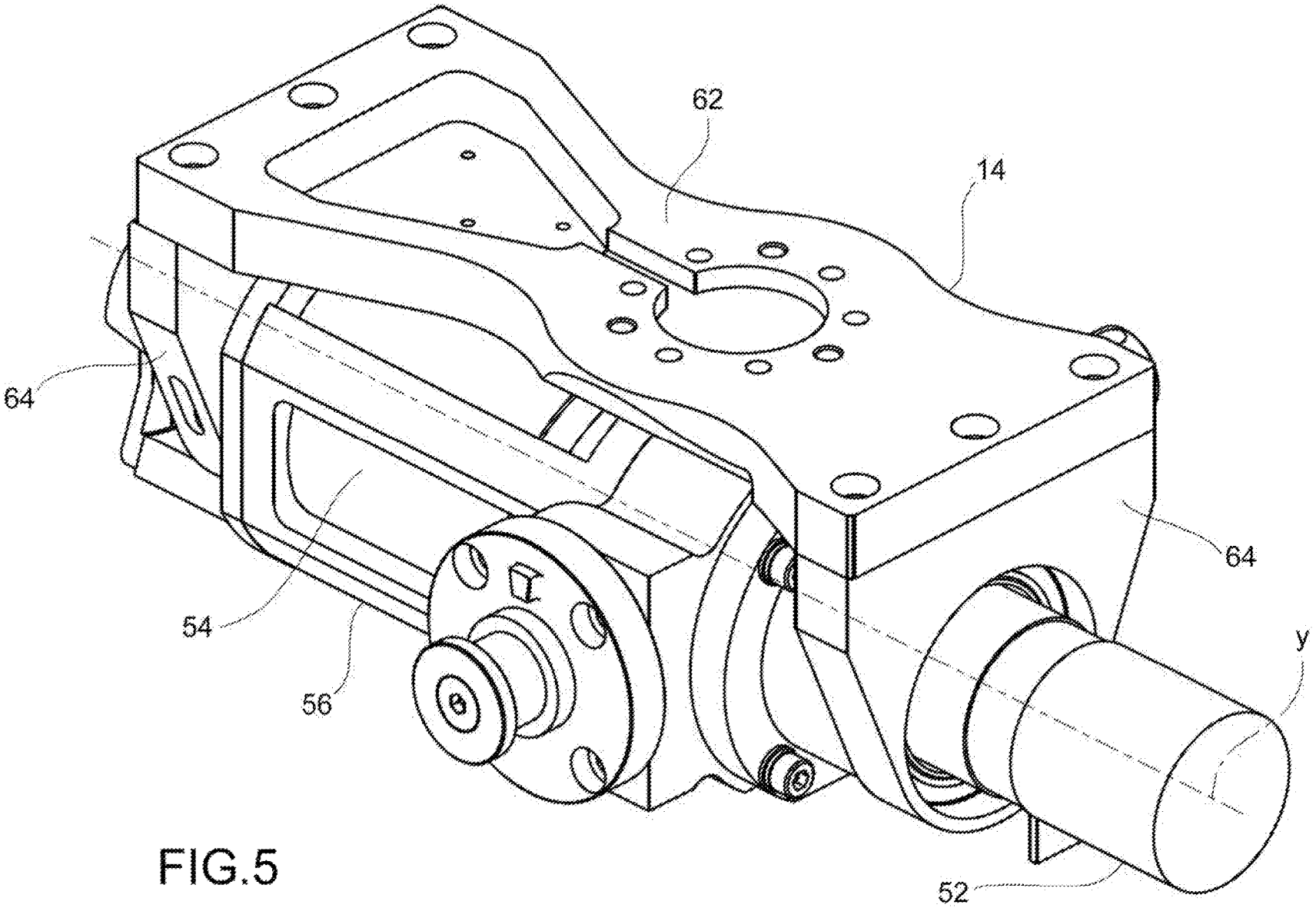
FIG. 5 is a perspective view of the second actuation unit of the driving system of FIG. 1.
Figure 6:
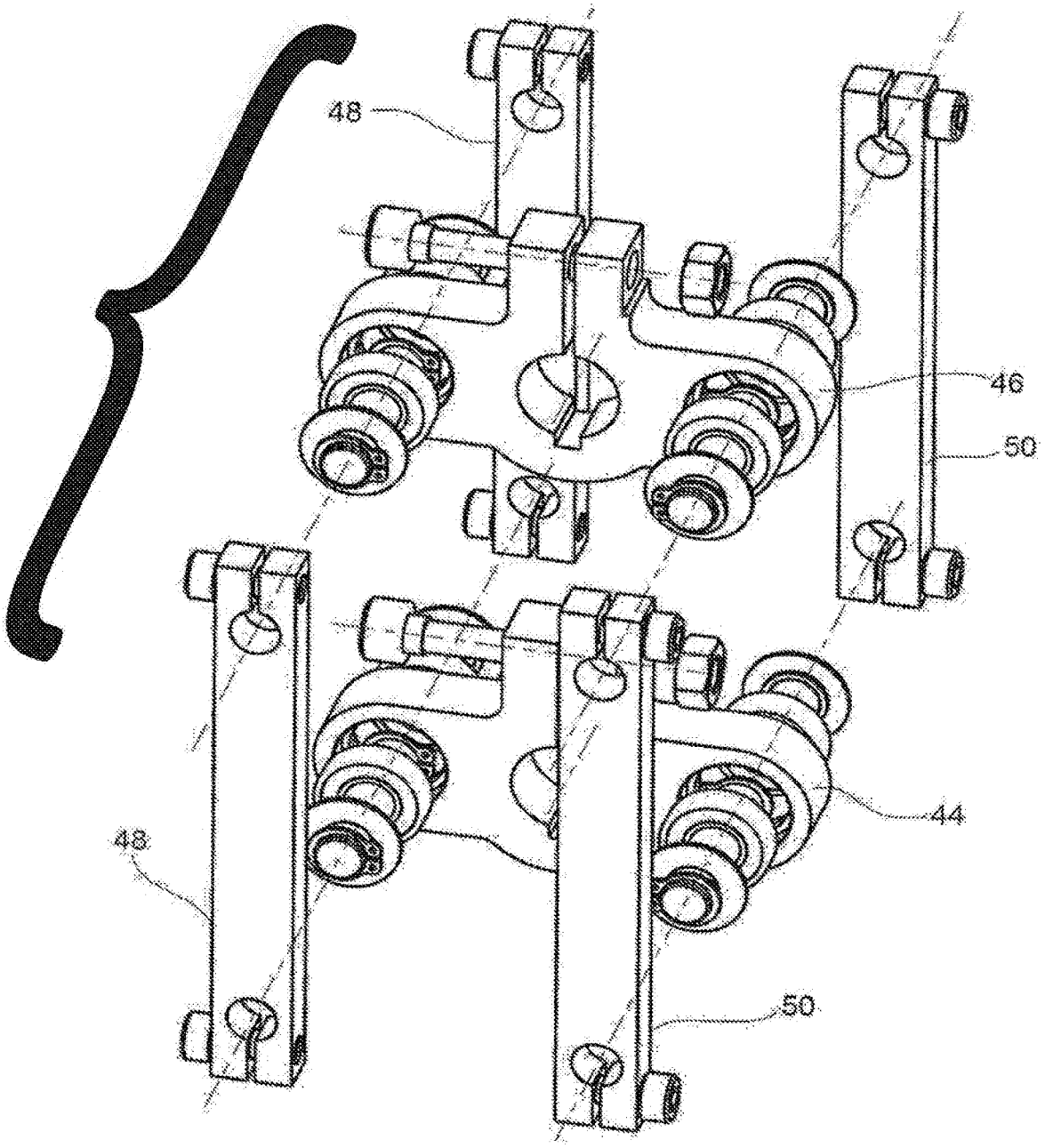
FIG. 6 is an exploded view of the second transmission mechanism of the first actuation unit of the driving system of FIG. 1.
Figure 7:
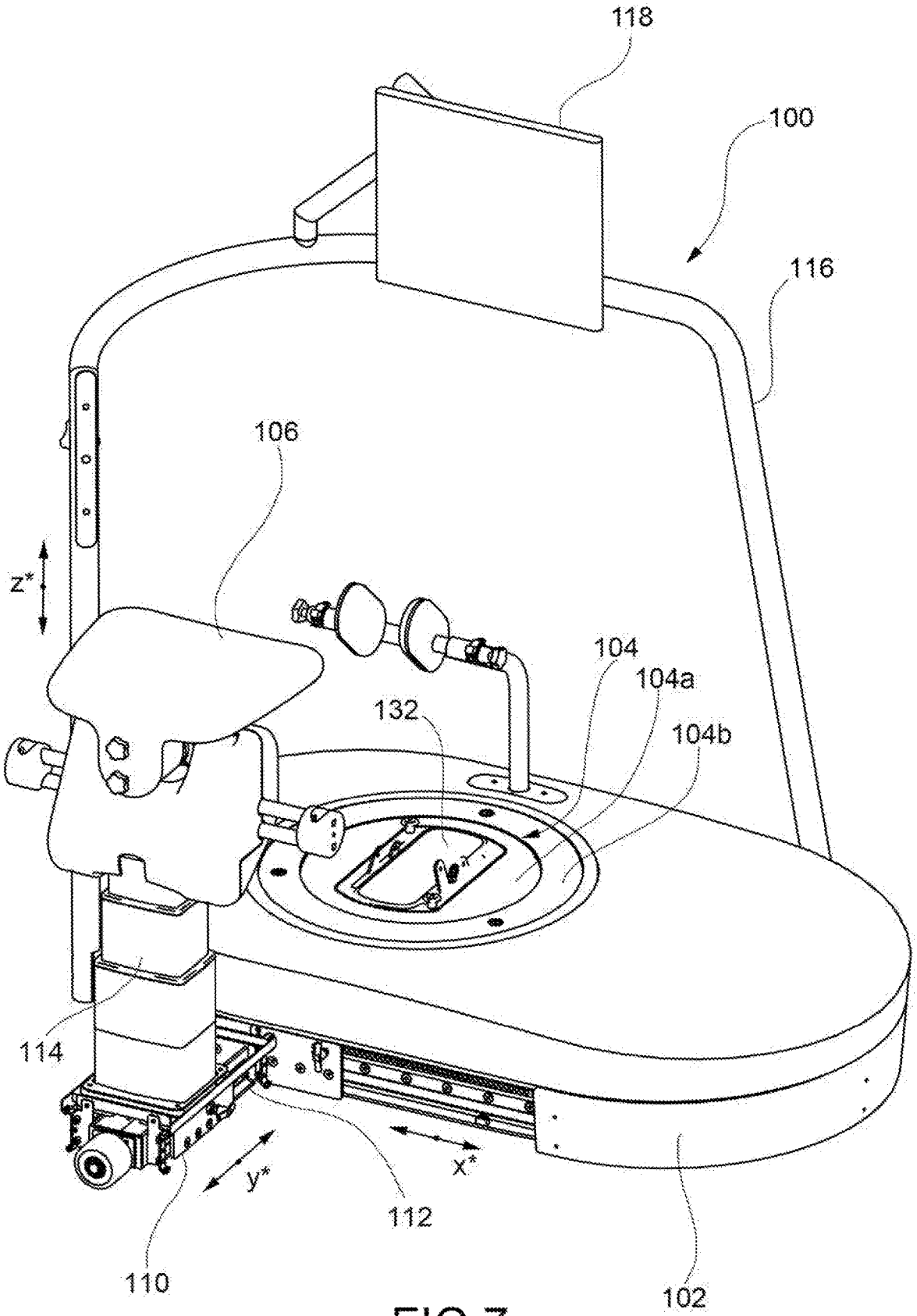
FIG. 7 is a perspective view of a rehabilitation machine for rehabilitation of the lower limbs and the trunk incorporating the driving system of FIG. 1.

With reference in particular to FIGS. 2 and 6, in the embodiment proposed herein the second motion transmission mechanism 30 is made as a parallelogram mechanism and comprises an input lever 44, which is mounted on the output shaft 34 of the reducer gear 26 so as to be drivingly connected for rotation therewith about the axis of rotation x1, an output lever 46, which is mounted on the first output member 12 so as to be drivingly connected for rotation therewith about the first axis of rotation x, a pair of first connecting rods 48 (or, .alternatively, a single first connecting rod) which are hinged at their opposite ends on one side with the input lever 44 and on the other with the output lever 46, and a pair of second connecting rods 50 (or, alternatively, a single second connecting rod) which are hinged at their opposite ends on one side with the input lever 44 and on the other with the output lever 46, the first and second connecting rods 48 and 50 being oriented parallel to each other.

Therefore, according to the embodiment proposed here, the rotary motion about the axis of rotation x2 generated by the electric motor 24 is transmitted via the first motion transmission mechanism 28, preferably with a transmission ratio greater than 1, to the input shaft 32 of the reducer gear 26, then from the input shaft 32 to the output shaft 34 of the reducer gear 26 with a transmission ratio greater than 1, and finally from the output shaft 34 of the reducer gear 26 to the first output member 12 via the second motion transmission mechanism 30, preferably with a transmission ratio equal to 1.

The second actuation unit comprises, in addition to the second output member 14, an electric motor 52 (the drive shaft of which is indicated 53) and a reducer gear 54, which are arranged aligned with each other along the second axis of rotation y. The electric motor 52 and the reducer gear 54 are mounted on a movable support structure 56 which is supported by the stationary support structure 16 for rotation about the first axis of rotation x and which is drivingly connected for rotation with the first output member 12. The second output member 14 is supported by the movable support structure 56, in particular by means of a pair of bearings 58, for rotation about the second axis of rotation y. The second output member 14 is drivingly connected for rotation with an output shaft 60 of the reducer gear 54. In this way, the rotary motion of the drive shaft 53 about the second axis of rotation y generated by the electric motor 52 is transmitted via the reducer gear 54, with a transmission ratio greater than 1, to the second output member 14.

In the embodiment proposed here, the second output member 14 comprises a mounting plate 62, to which the object to be moved by means of the driving system 10 can be directly or indirectly fixed, and a pair of lateral support plates 64, which extend perpendicular to the mounting plate 62 and each have a respective seat 66 in which one of the two bearings 58 is mounted. The mounting plate 62 may also have, mounted thereon, a six-axis load cell 68 which is therefore arranged between the object to be moved and the mounting plate 62 so as to provide a measurement of the forces and torques exchanged between the driving system 10 and the object to be moved.

Preferably, the driving system is provided with a first angular position sensor 70 (FIG. 2) arranged to provide a signal indicative of the angular position of the movable structure 56—and therefore of the second output member 14—about the first axis of rotation x, and with a second angular position sensor 72 (FIG. 4) arranged to provide a signal indicative of the angular position of the second output member 14 about the second axis of rotation y. Moreover, the electric motors 24 and 52 are preferably provided with respective angular position sensors of the per-se-known type (not shown) for allowing position and speed feedback control of the motors and/or of respective braking devices of the per-se-known type (not shown) for locking the second output member 14, and therefore the object to be moved fixed thereto, about the first axis of rotation x and/or about the second axis of rotation y.

The driving system 10 described above has been designed with particular reference to its use in a rehabilitation machine for rehabilitation of the lower limbs and the trunk, by means of which a patient may perform exercises both actively and passively, both in monopodalic mode and in bipodalic mode.

An example of a rehabilitation machine 100 (hereinafter simply referred to as "machine") incorporating the driving system 10 will now be described with reference to FIGS. 7 to 15. The machine 100, shown in its entirety in FIGS. 7 and 14, basically comprises a base structure 102, a platform 104 and a seat 106. The driving system described above is associated with both the platform 104 and the seat 106. The driving system associated with the platform 104 is indicated 10' and the two perpendicular axes of rotation about which the platform 104 may rotate under the control of the driving system 10' are indicated x' and y'. Moreover, the driving system associated with the seat 106 is indicated 10" and the two perpendicular axes of rotation about which the seat 106 may rotate under the control of the driving system 10" are indicated x" and y".

Figure 9:
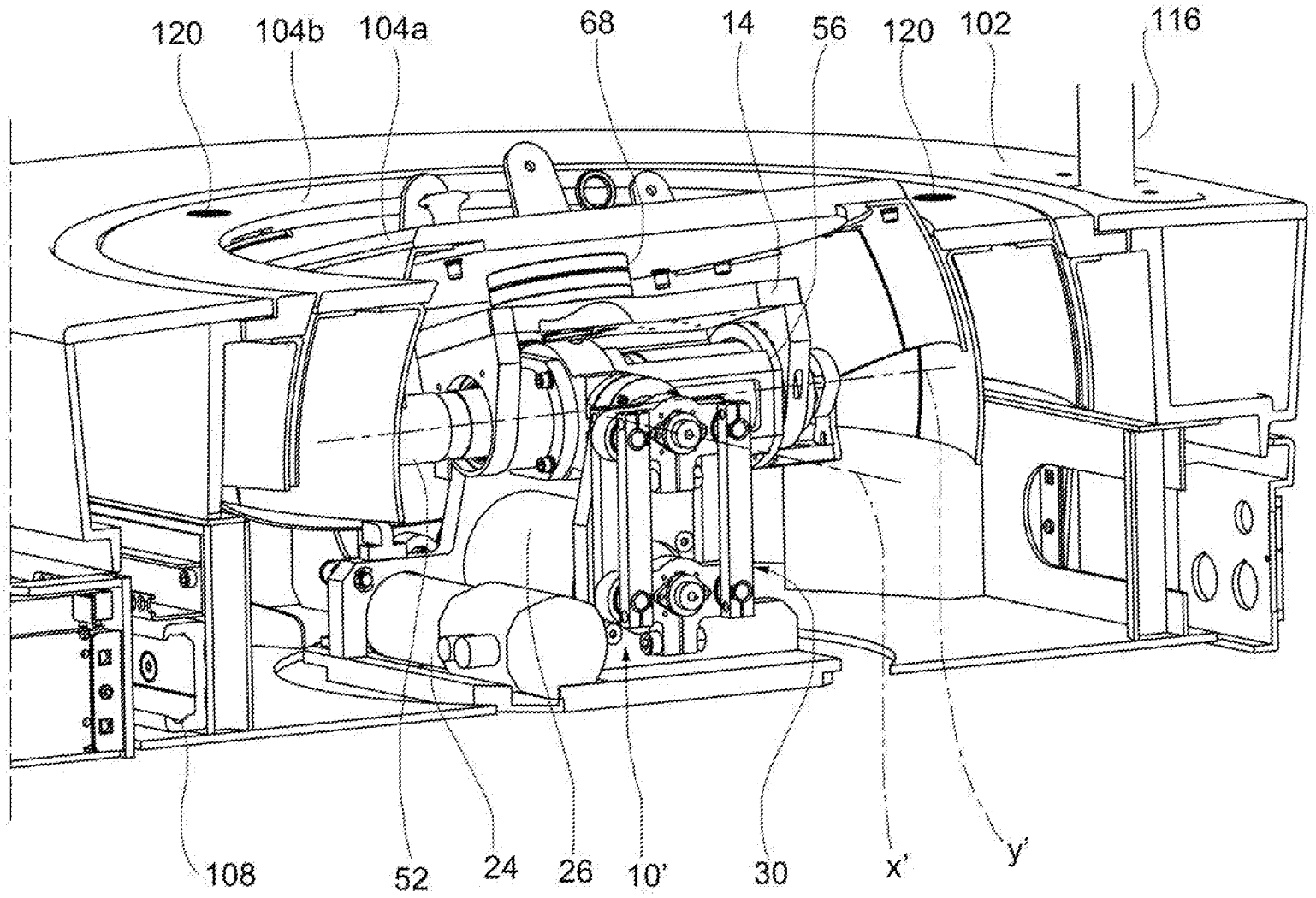
FIG. 9 is a cut-away view of she machine of FIG. 7, in the condition where the platform is configured for operation in monopodalic mode and is rotated through a certain angle about the second axis of rotation.
Figure 10:
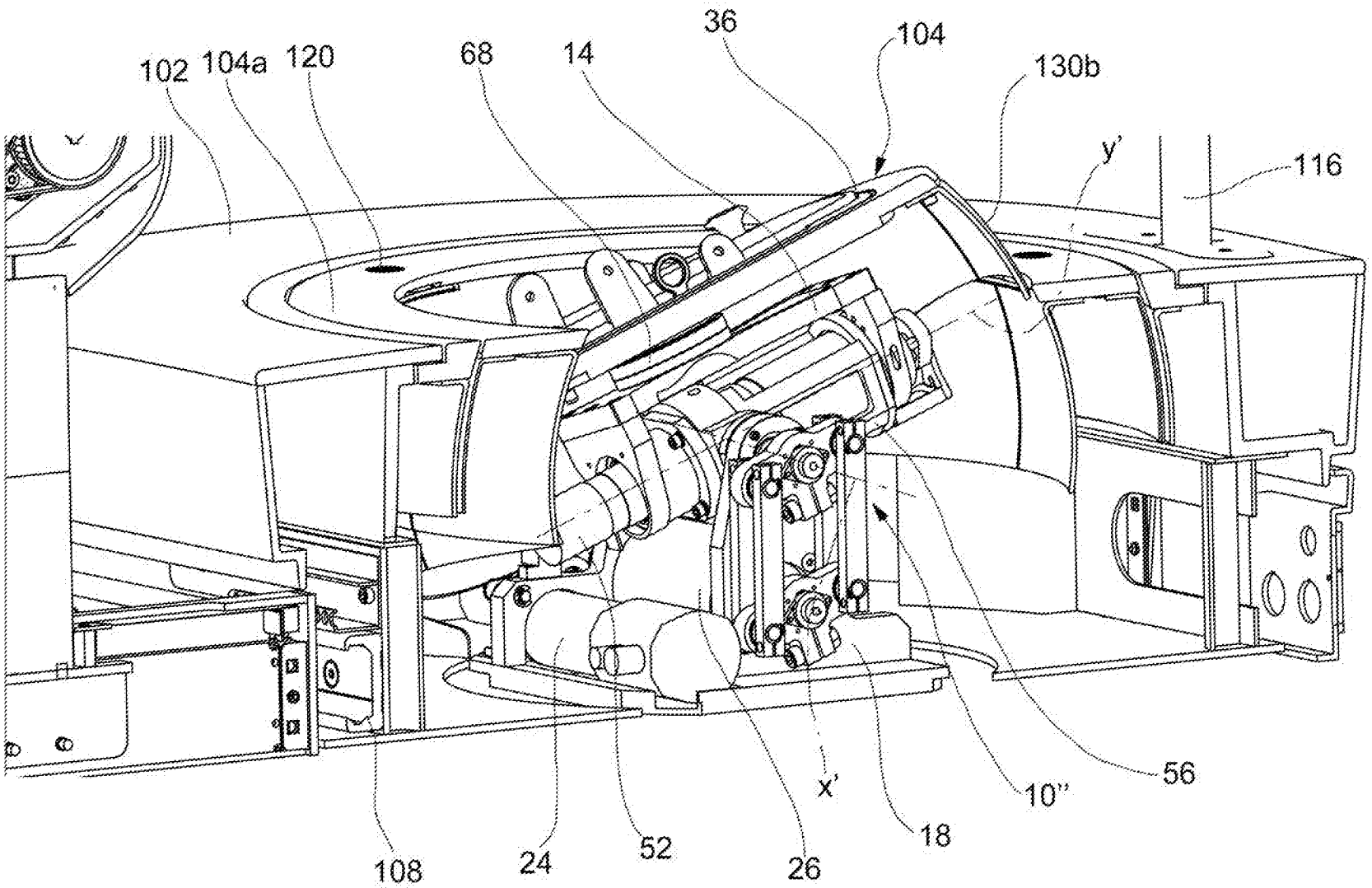
FIG. 10 is a cut-away view of the machine of FIG. 7, in the condition where the platform is configured for operation in bipodalic mode and is rotated through a certain angle both about the first axis of rotation and about the second axis of rotation.
Figure 11:
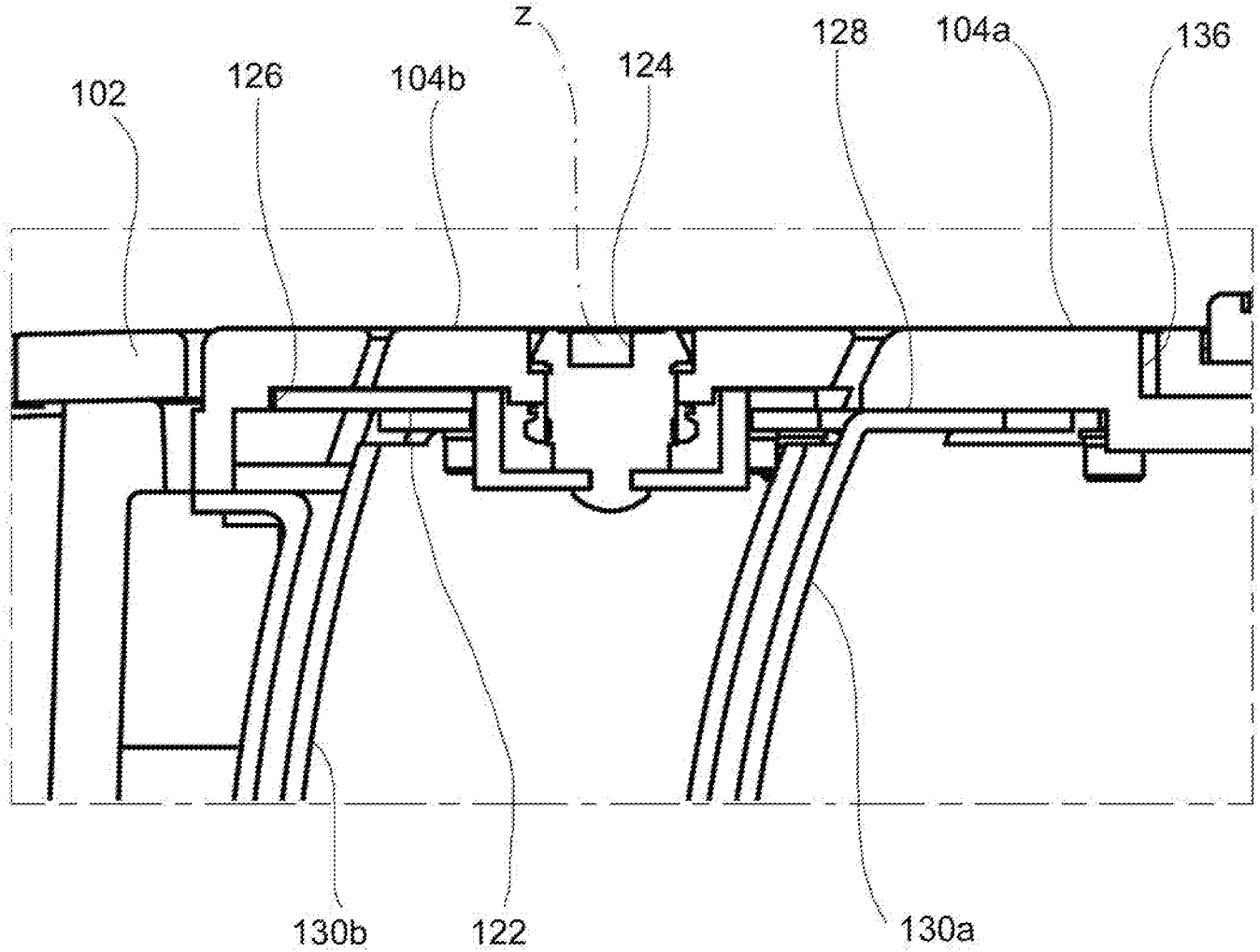
FIG. 11 is a cross-sectional view of a detail of the platform of the machine of FIG. 7.
Figure 12:
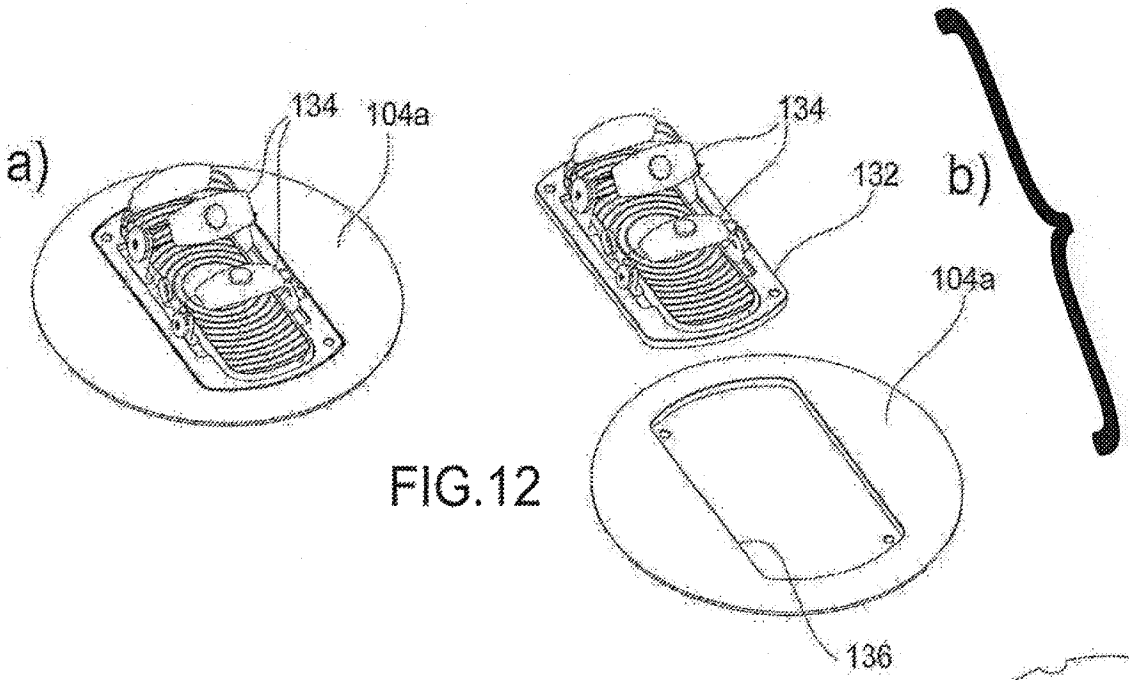
FIGS. 12*a* and 12*b* show the platform of the machine of FIG. 7 configured for operation in monopodalic mode.
Figure 13:
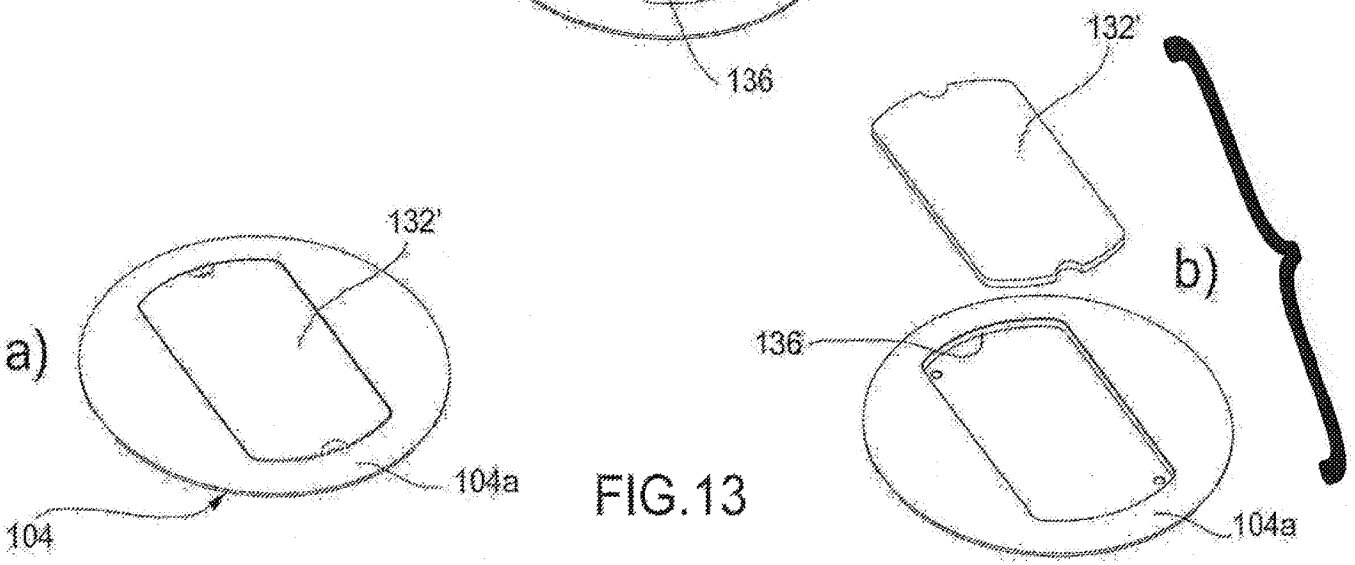
FIGS. 13*a* and 13*b* show the platform of the machine of FIG. 7 configured for operation in bipodalic mode.

The platform 104, as will be explained better further below, is con figured to allow the patient to rest thereon a single foot, in order to perform exercises in monopodalic mode, or both feet, in order to perform exercises in bipodalic mode. The platform 104 is fixed to the second output member 14 of the driving system 10', as shown in FIGS. 9 and 10, preferably with the six-axis load cell 68 arranged in between, so as to allow measurement of the forces and torques exchanged via the platform 104 between the patient and the machine. As is clear from FIGS. 8 to 10, the driving system 10', with both its actuation units, is arranged completely underneath the platform 104. The driving system 10', in turn, is mounted on the base structure 102.

The base, structure 102, together with the driving system 10' and the platform 104, is preferably mounted slidably, by means of linear guides 108 (only partially shown in FIGS. 7 to 10), along a horizontal direction x* parallel to the first axis of rotation x' of the platform 104, Preferably, the scat 106 is mounted on a carriage 110 which is slidable, by means of linear guides 112, along a horizontal direction y*, parallel to the second axis of rotation y' of the platform 104, and therefore perpendicular to the horizontal direction x*. Moreover, the seat 106 is preferably adjustable in height (direction z*) and for this purpose it may for example be mounted on a telescopic support 114 fixed to the carriage 110. According to the embodiment proposed herein, the position of the platform 104 with respect to the seat 106 may therefore be adjusted in the three directions x*, y* and z*. The movement of the base structure 102 along the direction x* and the movement of the seat 106 along the directions y* and z* are preferably controlled by respective actuation units, in particular electromechanical actuation units.

Figure 14:
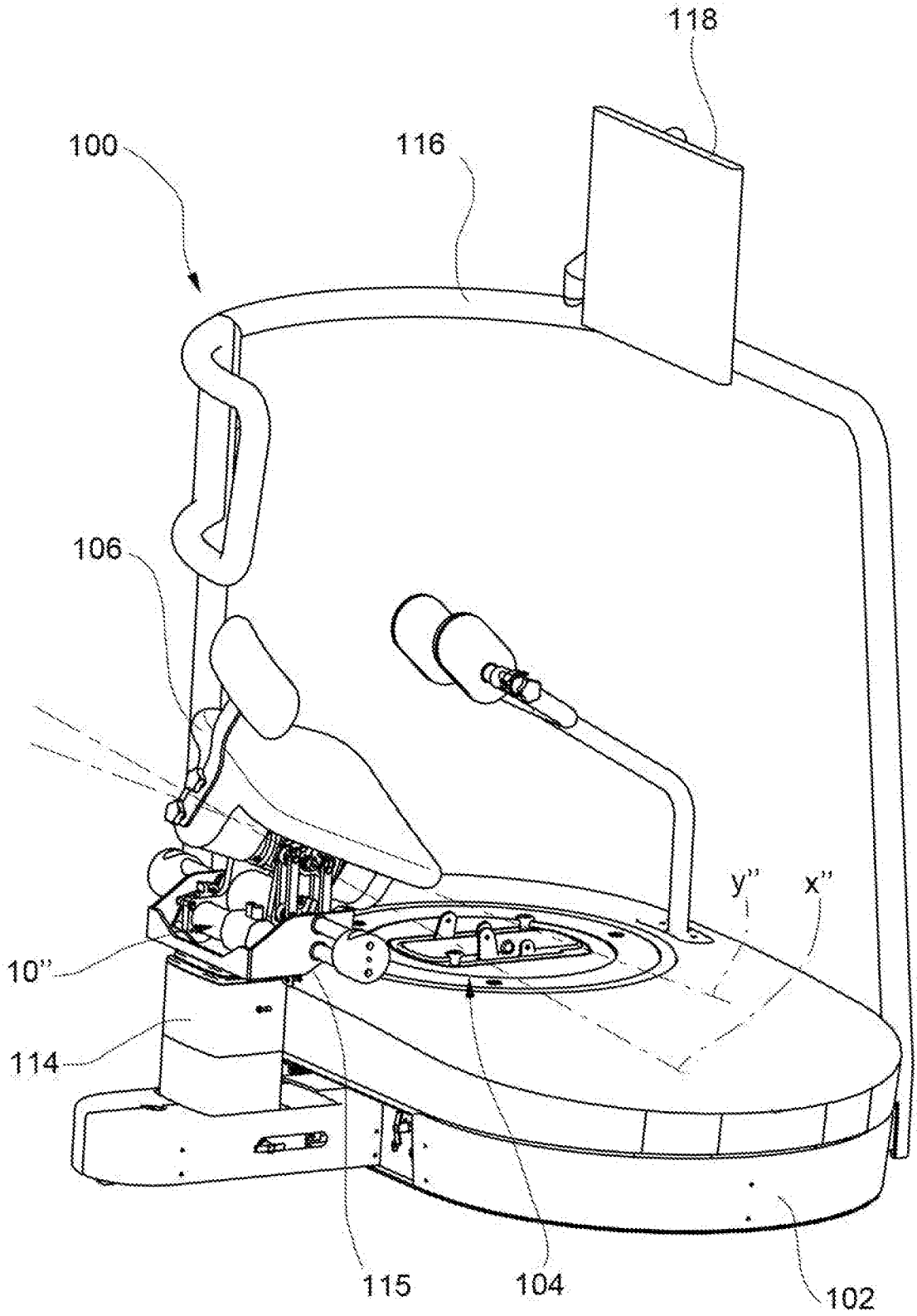
FIGS. 14 is a further perspective view of the machine of FIG. 7, showing the driving system associated with the seat.
Figure 15:
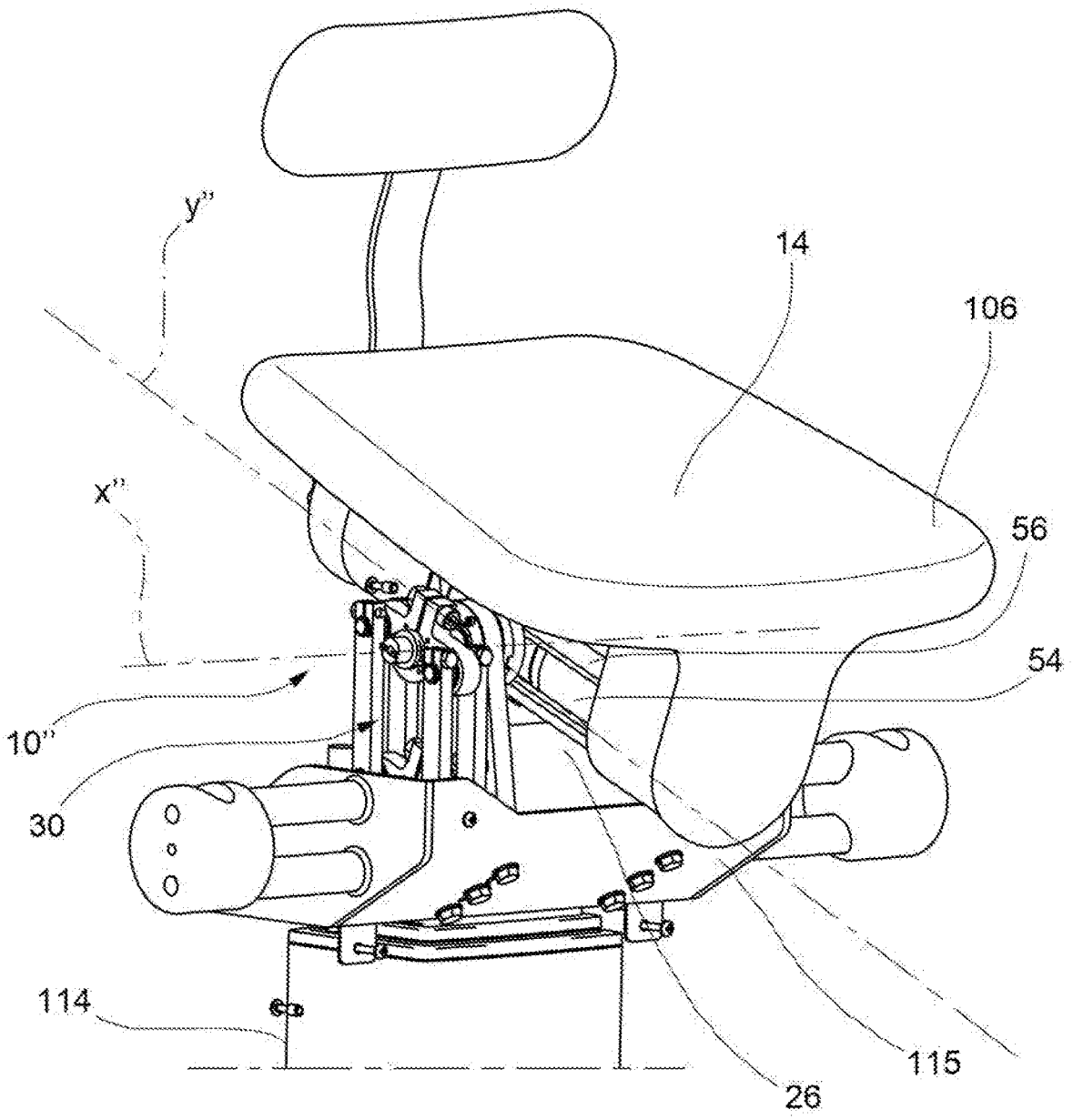
FIG. 15 is a perspective view showing, on an enlarged scale, the seat of the machine of FIG. 7 with the associated driving system.

As shown in FIGS. 14 and 15, the seat 106 is fixed to the second output member 14 of the driving system 10", preferably with the six-axis load cell 68 arranged in between, so as to allow measurement of the forces and torques exchanged via the seat 106 between the patient and the machine. The driving system 10", with both its actuation units, is arranged completely underneath the seat 106. The driving system 10" is in turn mounted on a support base 115 fixed to the top of the support 114.

An electronic control unit (not shown) manages the operation of the machine 100, suitably controlling the electric motors 24 and 52 of the two driving systems 10' and 10" and the electric motors (not shown) of the actuation units which control the rectilinear movement along the directions x*, y* and z*.

Preferably, the machine 100 further comprises a support bar 116 which is mounted on the base structure 102 and is configured to provide the patient with a gripping means, for example in order to prevent loss of balance. The support bar 116 is preferably fitted with a display 118 so as to allow for example programming of the exercises to be performed or displaying of data and information to the patent and/or to the physiotherapist.

Figure 8:
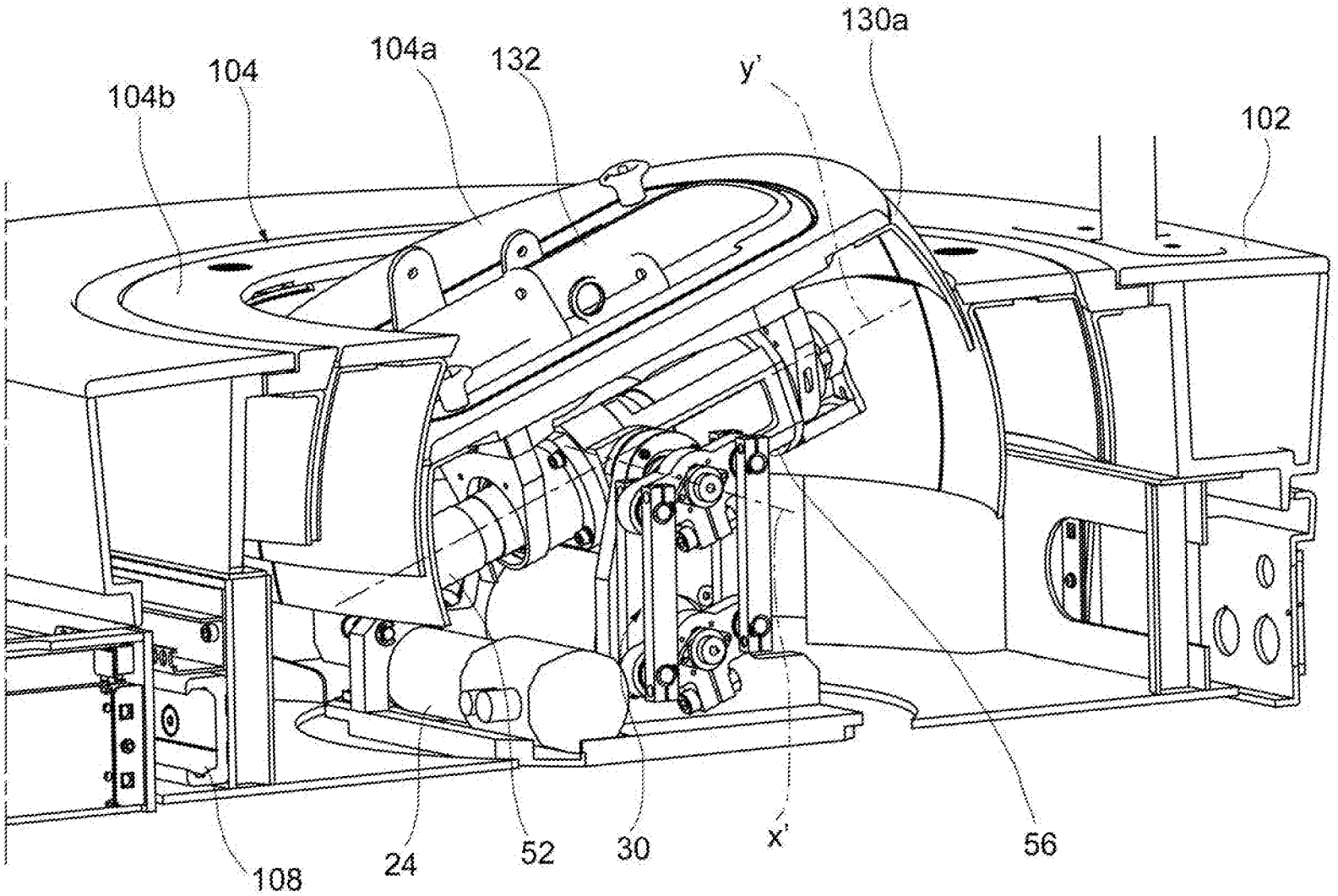
FIG. 8 is a cut-away view of the machine of FIG. 7, in the condition where the platform is configured for operation in monopodalic mode and is rotated through a certain angle about the first axis of rotation.

FIG. 8 shows a cut-away view of the machine 100, in particular of the base structure 102 with the driving system 10' and the platform 104, in the condition where the second output member 34 of the driving system 10', and together with it the platform 304, is rotated about the first axis of rotation x' only, in particular through the maximum angle of rotation allowed (which, is preferably equal to at least 35°). In the view of FIG. 9, on the other hand, the second output member 14 of the driving system 10', and together with it the platform 104, is rotated about the second axis of rotation y' only, in particular through the maximum angle of rotation allowed, (which is preferably equal to at least 20°). FIG. 10 shows the second output member 14 of the driving system 10', and together with it the platform 104, rotated through a certain angle both about the first axis of rotation x' and about the second axis of rotation y'.

Preferably, in order to allow to use the machine for performing exercises both in monopodalic mode and in bipodalic mode, the platform 104 comprises two platform parts separate from each other, i.e. a first platform part 104*a*, or inner platform part, with a circular shape, and a second platform part 104*b*, or outer platform part, with an annular shape, which extends around the first platform part 104*a*. The first platform part 104*a* is fixed, via the load cell 68, if any, to the second output member 14 of the driving system 10' and therefore moves as a single piece with this member. The second platform part 104*b* may be connected to the base structure 102, as shown in FIGS. 8 and 9, and therefore remain stationary, or may be connected to the first platform part 104*a*, as shown in FIG. 10, and therefore move as a single piece therewith under the control of the driving system 10'. For this purpose, the platform 104 is provided for example with a plurality of coupling devices 120 (three devices 120 arranged at 120°, in the embodiment proposed herein) which are mounted on the second platform part 104*b* and each comprise, as shown in detail in FIG. 11, a lever 122 mounted rotatably about a respective axis of rotation z perpendicular to the plane of the second platform part 104*b*. The lever 122 of each, coupling device 120 may be rotated, for example by means of a key (not shown) to be inserted into a slot 124, between a first position (FIG. 7), where she lever 122 engages in a respective seat 126 of the base structure 102, and therefore connects the second platform part 104*b* to the base structure 102, and a second position (not shewn), where the lever 122 is disengaged from the respective seat 126 of the base structure 102 and engaged in a respective seat 128 of the first platform part 104*a*, thus connecting the second platform part 104*b* to the first platform part 104*a*. The first platform part 104*a* has preferably a diameter of not more than 40 cm, so as to allow the patient to rest his/her foot on the platform in a natural position, resting with one foot on the platform and with the other foot on the stationary surface of the base structure. The second platform part 104*b* has preferably a diameter of not less than 50 cm, for example a diameter of 55 cm, so as to allow the patient to rest both feet on the platform in a natural position.

Preferably, the platform 104 further comprises a first side cover 130*a* which extends along the entire perimeter of the first platform part 104*a* and a second side covet 130*b* which extends along the entire perimeter of the second platform part 104*b*.

The first platform part 104*a* is advantageously configured to be used both for rehabilitation, of the heel and for performing monopodalic exercises. In order to perform heel rehabilitation exercises, the patient's foot must be rigidly connected to the first platform part 104*a* so that the flexion/extension axis of the heel is aligned with the first axis of rotation x' of the driving system 10' and the aversion/inversion axis of the heel is aligned with the second axis of rotation y' of the driving system 10'. For this purpose, the first platform part 104*a* has, mounted thereon, as shown in FIGS. 12*a* and 12*b*, a foot support plate 132 provided with fastening means 134 for fastening the patient's foot to the plate 132, and hence to the first platform part 304*a*. Preferably, in order to ensure correct orientation of the plate 132 with respect to the first platform part 104*a*, and hence with respect to the two axes of rotation x' and y' of the driving system 10', the first platform part 104*a* has an elongated seat 136 along the second axis of rotation y1 with a shape matching that of the plate 132. In order to perform monopodalic exercises, on the other hand, a plate 132' without fastening means is used, said plate, once inserted into the seat 136 of the first platform part 104*a,* creating together with this platform part a flat support surface for the patient's foot, as shown in FIGS. 13*a* and 13*b*.

In the light of the description provided above the advantages which can be achieved with a driving system according to the invention and with a rehabilitation machine incorporating such a driving system are evident.

The driving system according to the present invention is arranged entirely underneath the second output member, and hence underneath the object to be moved, once the latter has been fixed to the second output member. This allows to obtain wide angular ranges of movement about the two axes of rotation, corresponding to the physiological angular ranges of the heel joint. At the same time, the driving system according to the invention has a very compact structure, in particular in height, so that neither steps nor a support base are required to allow the patient to mount the platform.

The rehabilitation machine incorporating the driving system according to the invention is able to be used for rehabilitation not only of the heel, but also of all the lower limb joints, as well as for rehabilitation of the vertebral column and for equilibrium and trunk stability training. With the machine, in fact, it is possible to perform exercises both in the sitting position and in the standing position, and with resting of just one foot or of both feet. The machine also allows exercises to be performed both actively, i.e. with the patient who actively performs the required movements, and passively, i.e. with the machine which acts on the patient to make him/her perform the required movements, and also in an assisted manner, i.e. with the machine which helps the patient to perform the required movements when the patient is unable to perform them autonomously. All the exercises provided for by the rehabilitation protocols may therefore he performed using the same machine.

More specifically, the machine allows heel rehabilitation exercises to be performed both in the sitting position and in the standing position, in the sitting position, the machine allows to perform exercises for the passive mobilization of the heel with predetermined angular movement ranges, exercises for active mobilization of the heel, exercises for assisted mobilization of the heel, as well as isometric, isotonic and isokinetic exercises. The machine allows to perform these exercises with different resistance levels and using both a resistance of elastic type and a resistance of fluid-dynamic type. In the standing position, the patient may rest only one foot on the platform and perform both, proprioceptive exercises and strengthening exercises, like in the sitting position.

Furthermore, the machine allows treatment of the lower limbs in the standing position both in monopodalic mode and in bipodalic mode. In particular, the machine allows to move the platform by means of the driving system with different resistance levels, for example to perform, isotonic exercises for the lower limbs or proprioceptive exercises. The machine also allows the patient to actively move the platform to bring it back in a final equilibrium position from a given initial position set by the driving system.

The machine also allows to perform exercises for the stability of the trunk and for rehabilitation of the vertebral column both in monopodalic mode and in bipodalic mode, both in the standing position and in the sitting position. In this case, it is also possible to treat the patient actively or passively, selecting the resistance level as well as the speed and travel of the seat. In the active mode, the patient may move the platform with different resistance levels to perform proprioceptive exercises and train his/her control of the movement. In the passive mode, the movement of the platform under the control of the driving system allows to perform passive mobilization exercises for the pelvis and exercises for stretching the trunk muscles.

The machine also allows to train the stability and equilibrium of the patient, with the patient standing and resting both feet on the platform.

Owing to the position sensors associated with the two axes of rotation of the platform and to the load cell arranged between the second output member and the platform, the machine is able to measure displacements and speed of the platform and also forces/torques exchanged between the patient and platform, thus providing the physiotherapist with an objective and complete overview of the patient's performance, in order for example to define the rehabilitation program and monitor the progress of said program.

Naturally, the principle of the invention remaining unchanged, the embodiments and the constructional details may vary widely from those described and illustrated purely by way of non-limiting example, without thereby departing from the scope of the invention as defined in the appended claims.

The invention claimed is:

1. A driving system for controlling the movement of an object with two degrees of freedom of rotation about a first axis of rotation and a second axis of rotation, said first and second axes of rotation being perpendicular to each other and intersecting each other at an intersection point, the driving system comprising a first support structure which is stationary, a second support structure which is supported by the first support structure for rotation about said first axis of rotation, said first axis of rotation being fixed to the first support structure, a first actuation unit having a first motor device, a first output member and a first motion transmission system, and a second actuation unit having a second motor device, a second output member and a second motion transmission system, wherein the first output member is drivingly connected with the second support structure for rotation about the first axis of rotation, wherein the first motor device is arranged to control, via said first motion transmission system, the rotation of the first output member, along with the second support structure, about the first axis of rotation and comprises a first motor and a first drive shaft arranged to be driven by the first motor to rotate about a first motor axis, wherein the second output member is supported by the second support structure for rotation about said second axis of rotation, said second axis of rotation being fixed to the second support structure, so as to rotate alongside the second support structure, wherein the second motor device is arranged to control, via said second motion transmission system, the rotation of the second output member about the second axis of rotation and comprises a second motor and a second drive shaft arranged to be driven by the second motor to rotate about a second motor axis, wherein the second actuation unit is supported by the second support structure so as to be drivingly connected with the second support structure for rotation about the first axis of rotation, wherein the object to be moved, once fixed to the second output member, is rotatable about the first axis of rotation under the control of the first actuation unit and about the second axis of rotation under the control of the second actuation unit, wherein the first motor axis is arranged parallel to, and spaced from, the first axis of rotation and the second motor axis is coaxial with the second axis of rotation, wherein the first axis of rotation is oriented horizontally and wherein the first motor axis is arranged underneath the first axis of rotation and at a distance from a vertical plane passing through the first axis of rotation; and wherein said first motion transmission system comprises a first reducer gear having an input shaft and an output shaft which are rotatable about a same axis of rotation arranged underneath the first axis of rotation, a first motion transmission mechanism operatively arranged between the first motor and the reducer gear so as to transmit to the input shaft of the reducer gear the rotary motion of the first drive shaft produced by the first motor, and a second motion transmission mechanism operatively arranged between the reducer gear and the first output member so as to transmit to the first output member the rotary motion of the output shaft of the reducer gear.

2. A driving system as set forth in claim 1, wherein said second motion transmission system comprise a reducer gear arranged coaxially with the second motor.

3. A rehabilitation machine for rehabilitation of the lower limbs and the trunk of a patient, comprising a base structure, a platform mounted on the base structure and configured to allow the patient to rest on it with one foot only or with both feet, a seat, a first driving system according to any one of the preceding claims for controlling the movement of the platform with two degrees of freedom of rotation about two perpendicular axes of rotation, a second driving system according to any one of the preceding claims for controlling the movement of the seat with two degrees of freedom of rotation about two perpendicular axes of rotation, and a control unit for controlling the first and second driving systems to cause movement of the platform and of the seat according to predetermined operating modes.

4. The rehabilitation machine as set forth in claim 3, further comprising a linear movement device for moving the seat relative to the base structure, and hence relative to the platform, along three perpendicular directions.

5. The rehabilitation machine as set forth in claim 3, wherein the platform comprises a first platform part connected to the second output member of the first driving system, a second platform part which extends around the first platform part and is separate therefrom, and a locking device for connecting selectively the second platform part to the base structure or to the first platform part.

6. The rehabilitation machine as set forth in claim 3, further comprising a force and/or torque sensor device arranged between the second output member of the first driving system and the platform and between the second output member of the second driving system and the seat so as to provide signals indicative of the forces and/or torques exchanged between the patient and the first driving system via the platform and between the patient and the second driving system via the seat.

* * * * *